US005799786A

United States Patent [19]

Beck et al.

[11] Patent Number: 5,799,786

[45] Date of Patent: Sep. 1, 1998

[54] GOLF BAG WITH STAND

[76] Inventors: Edwin Beck, 139 Lewis Warf, Boston, Mass. 02110; Chuck Heidenreich, 31 Susan Dr., Westfield, Mass. 01085

[21] Appl. No.: 789,363

[22] Filed: Jan. 27, 1997

[51] Int. Cl.[6] ..... A63B 55/00

[52] U.S. Cl. ..... 206/315.7; 248/96

[58] Field of Search ..... 206/315.3, 315.7; 248/96

[56] References Cited

U.S. PATENT DOCUMENTS

| | | | |
|---|---|---|---|
| 1,181,007 | 10/1916 | Henneberg | 248/96 |
| 1,197,298 | 9/1916 | McGregor | 248/96 |
| 1,578,910 | 3/1926 | Nidle | 248/96 |
| 4,798,357 | 1/1989 | Cho | 206/315.7 X |
| 4,834,235 | 5/1989 | Solheim et al. | 206/315.7 |
| 5,351,921 | 10/1994 | Chen | 206/315.7 X |
| 5,407,155 | 4/1995 | Chung | 206/315.7 X |
| 5,415,285 | 5/1995 | Reimers | 206/315.3 X |
| 5,607,128 | 3/1997 | Suk | 206/315.7 X |
| 5,673,879 | 10/1997 | Hsieh | 206/315.7 X |

*Primary Examiner*—Allan N. Shoap
*Assistant Examiner*—Tri M. Mai

[57] ABSTRACT

A golf bag with an associated stand comprising a bag bottom and a bag top formed of a generally rigid material with a separator of a generally rigid material and an enclosure and a guide bracket fixedly secured to the bag with a circular bore extending therethrough in a vertical orientation and a foot pivotally secured through a foot pivot point to the leg bottom; a first link formed as an elongated activating rod having a lower end secured to the foot and having an upper end with an intermediate portion slidably received within the guide bracket; a second link formed as a pair of legs having lower ends positionable in a retracted orientation adjacent to the lower end of the bag and positionable in a deployed orientation remote from the bag, the legs having upper ends; a third link formed as a link having an interior end pivotally secured to the activating rod adjacent its upper end and having an exterior end pivotally attached to the upper ends of the legs and having an intermediate pivot point fixedly secured with respect to the bag; and a fourth link formed as a wire link with a lower end pivotally secured with respect to the activating rod and having an upper end pivotally secured to the legs adjacent to the L-shaped link.

3 Claims, 6 Drawing Sheets

GOLF BAG WITH STAND

BACKGROUND OF THE INVENTION

1. Field of the Invention

The present invention relates to a golf bag with stand and more particularly pertains to providing a golf bag with a retractable stand which moves to a deployed orientation through a generally flat arc.

2. Description of the Prior Art

Golf bag stands heretofore devised and utilized for the purpose of moving the legs of a golf bag stand between deployed and retracted orientations are known to swing the stand legs in large awkward circular arcs and consist basically of familiar, expected, and obvious structural configurations, notwithstanding the myriad of designs encompassed by the crowded prior art which has been developed for the fulfillment of countless objectives and requirements.

By way of example, U.S. Pat. No. Re. 33,203 to Reimers; U.S. Pat. No. 5,042,654 to Jones; U.S. Pat. No. 5,178,273 to Igarashi; U.S. Pat. No. 5,209,350 to Maeng; U.S. Pat. No. 5,356,003 to Gretz and U.S. Pat. No. 5,415,285 to Reimers.

While these devices fulfill their respective, particular objectives and requirements, the aforementioned patents do not describe a golf bag with a stand that allows movement between deployed and retracted orientations through a generally flat arc.

In this respect, the golf bag with stand according to the present invention substantially departs from the conventional concepts and designs of the prior art, and in doing so provides an apparatus primarily developed for the purpose of golf bag with a stand that allows movement between deployed and retracted orientations through a generally flat arc.

Therefore, it can be appreciated that there exists a continuing need for a new and improved golf bag with stand which can be used for movement between deployed and retracted orientations through a generally flat arc. In this regard, the present invention substantially fulfills this need.

SUMMARY OF THE INVENTION

In view of the foregoing disadvantages inherent in the known types of golf bag stands now present in the prior art, the present invention provides an improved golf bag with stand. As such, the general purpose of the present invention, which will be described subsequently in greater detail, is to provide a new and improved golf bag with stand and method which has all the advantages of the prior art and none of the disadvantages.

To attain this, the present invention essentially comprises A new and improved golf bag with an associated stand comprising, in combination a bag bottom formed of a generally rigid material having an imperforate upper surface for receiving thereon upper ends of golf clubs and a lower surface positionable on the ground, the bag bottom also having a periphery of a first shape, a bag top formed of a generally rigid material having apertures therethrough for receiving golf clubs to be carried, the bag top having a periphery of a shape essentially coextensive with the first shape of the bag bottom, a plurality of parallel bag stays of a generally rigid material having upper ends secured to the bag top periphery and having lower ends secured to the bag bottom periphery to maintain the bag top and bottom at a fixed distance from each other, the distance being less than the length of golf clubs to be carried therein, the bag stays including front stays and rear stays, a fabric enclosure surrounding the bag stays with upper end coupled to the bag top and a lower end coupled to the bag bottom, a guide bracket fixedly secured to the front stays with a circular bore extending therethrough in a vertical orientation essentially parallel with the bag stays, a foot pivotally secured through a foot pivot point to the lower surface of the bag bottom having an upper surface and a lower surface positionable on the ground, an elongated activating rod having a lower end pivotally secured to the foot at its end remote from the foot pivot point and having an upper end positioned spaced beneath the bag top with an intermediate portion slidably received within the guide bracket, a pair of legs having lower ends with balls positionable in a retracted orientation adjacent to the lower end of the front stays and positionable in a deployed orientation remote from the foot for forming with the foot a three-point contact on the ground for holding the bag upon the ground, the legs having upper ends with apertures, an L-shaped link having an interior end pivotally secured to the activating rod adjacent its upper end above the guide bracket and having an exterior end with a pin pivotally attached to the upper ends of the legs and having an intermediate pivot point fixedly secured with respect to the front bag stays; and a wire link in a V-shaped configuration with a lower end pivotally secured with respect to the activating rod beneath the guide bracket and having upper ends pivotally secured to the legs adjacent to the L-shaped link whereby placing the bag on the ground and pivoting it forward will pivot the foot upwardly to raise the activating rod and thereby raise the lower end of the wire link and the interior end of the L-shaped link to move the legs from the retracted orientation to the deployed orientation.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved golf bag with stand which has all of the advantages of the prior art Golf bag stands and none of the disadvantages.

It is another object of the present invention to provide a new and improved golf bag with stand which may be easily and efficiently manufactured and marketed.

It is further object of the present invention to provide a new and improved golf bag with stand which is of durable and reliable constructions.

An even further object of the present invention is to provide a new and improved golf bag with stand which is susceptible of a low cost of manufacture with regard to both materials and labor, and which accordingly is then susceptible of low prices of sale to the consuming public, thereby making such golf bag with stand economically available to the buying public.

Even still another object of the present invention is to provide a golf bag with stand for providing a golf bag with a retractable stand which moves to a deployed orientation through a generally flat arc.

Lastly, it is an object of the present invention to provide a new and improved golf bag with an associated stand comprising a bag bottom and a bag top formed of a generally rigid material with a separator of a generally rigid material and an enclosure and a guide bracket fixedly secured to the bag with a circular bore extending therethrough in a vertical orientation and a foot pivotally secured through a foot pivot point to the bag bottom; a first link formed as an elongated activating rod having a lower end secured to the foot and having an upper end with an intermediate portion slidably received within the guide bracket; a second link formed as a pair of legs having lower ends positionable in a retracted orientation adjacent to the lower end of the bag and positionable in a deployed orientation remote from the bag, the legs having upper ends; a third link formed as a link having an interior end pivotally secured to the activating rod adjacent its upper end and having an exterior end pivotally attached to the upper ends of the legs and having an intermediate pivot point fixedly secured with respect to the bag; and a fourth link formed as a wire link with a lower end pivotally secured with respect to the activating rod and having an upper end pivotally secured to the legs adjacent to the L-shaped link.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
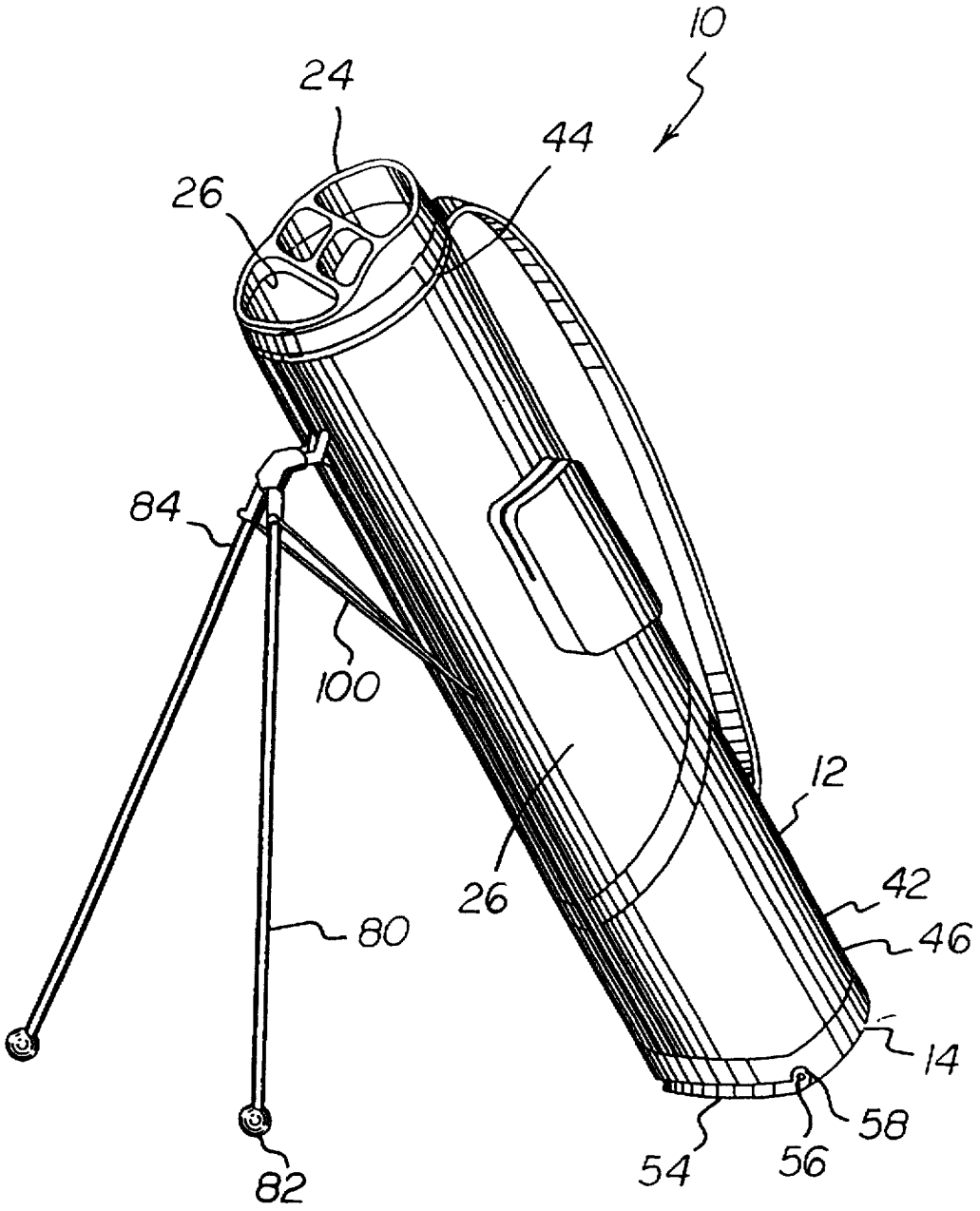
FIG. 1 is a perspective view of the preferred embodiment of the golf bag with stand.
Figure 2:
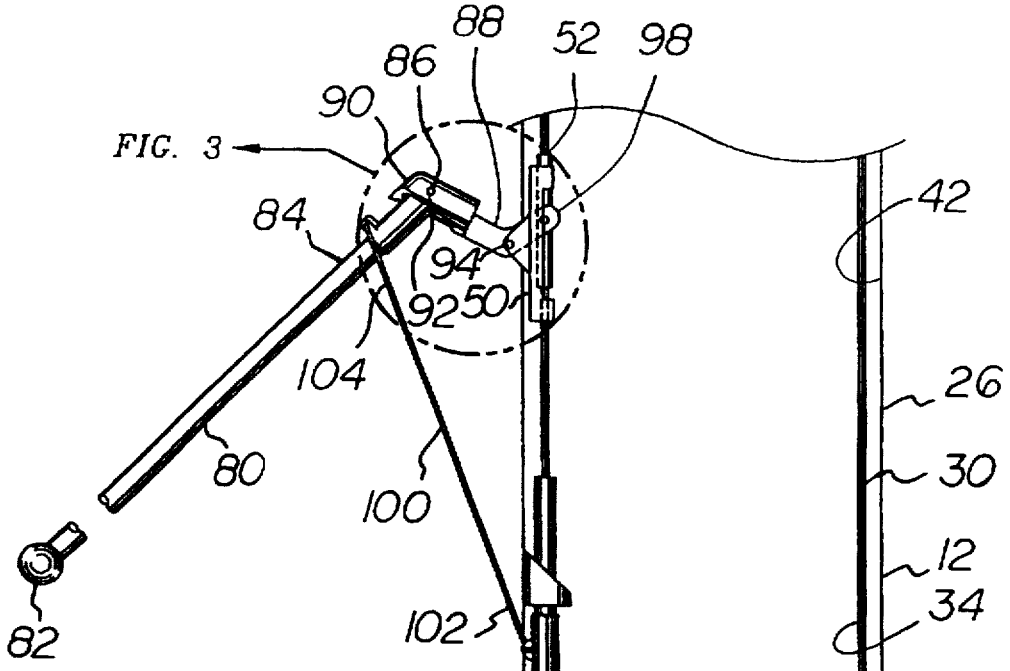
FIG. 2 is a side cross sectional view of device shown in FIG. 1 while in the deployed orientation.
Figure 3:
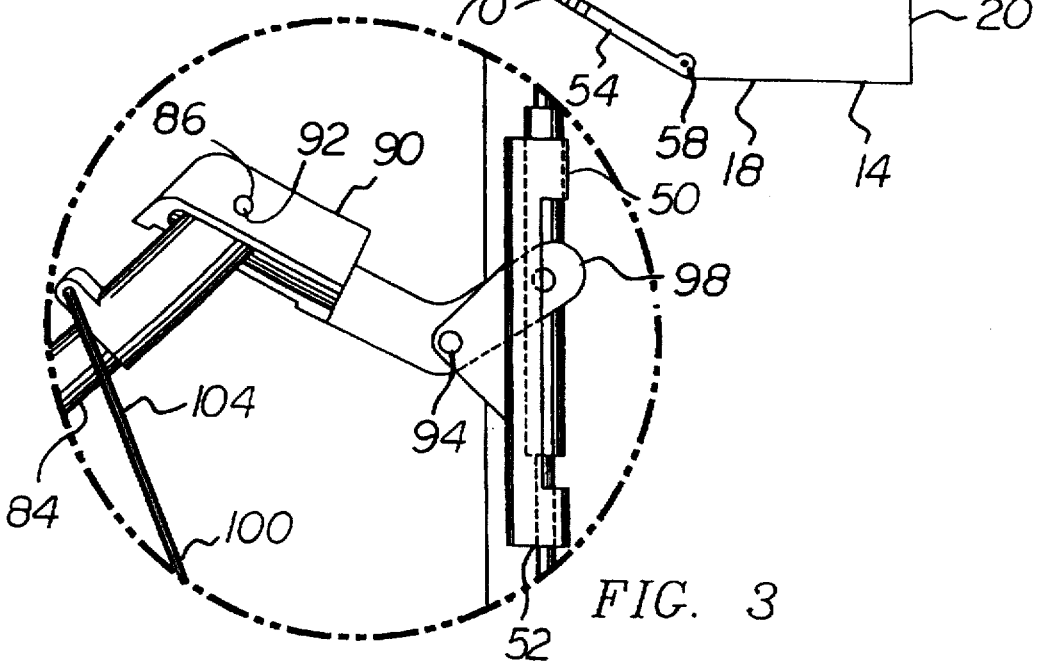
FIG. 3 is a close-up view of the L-shaped link of the present invention.
Figure 4:
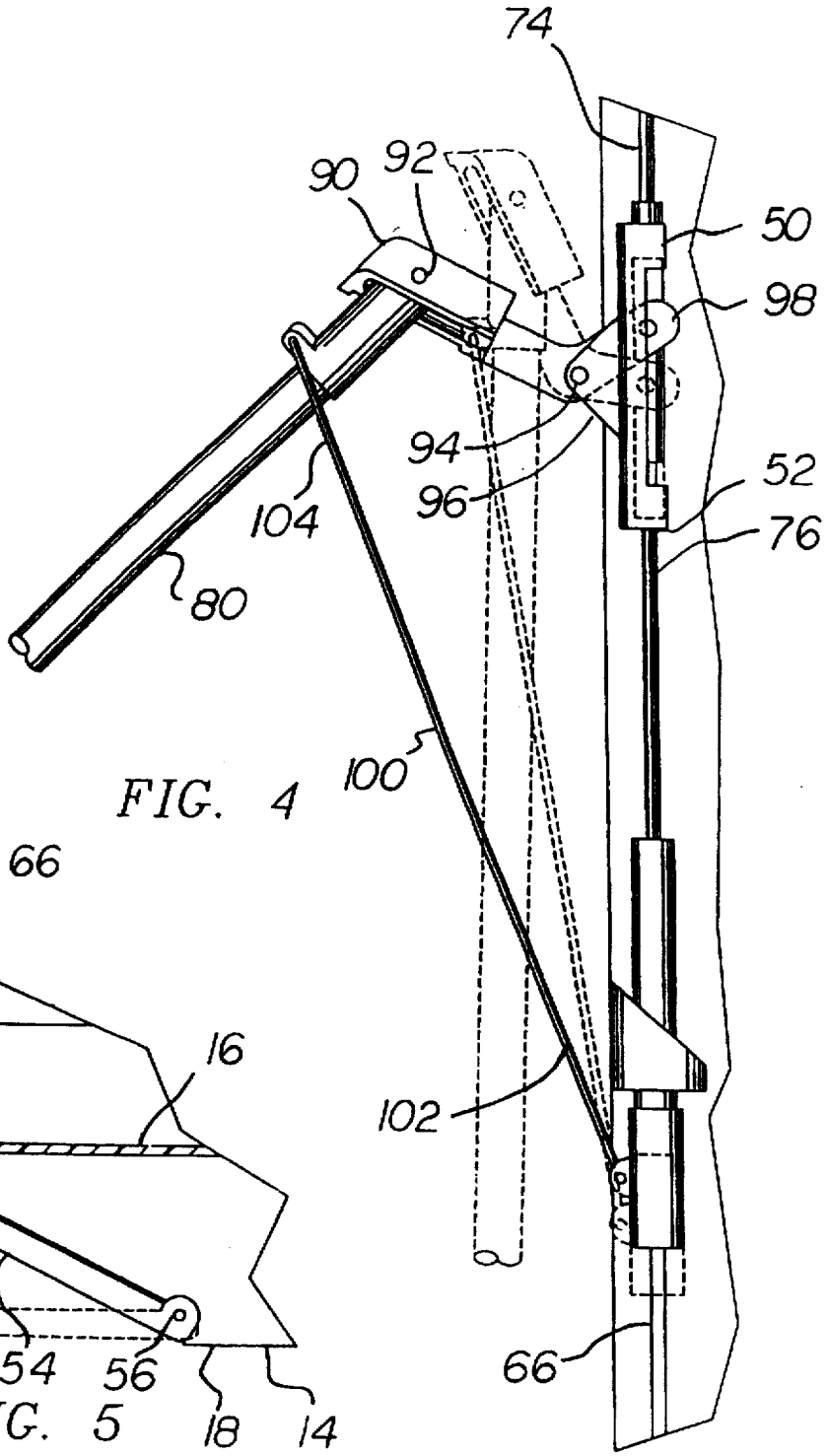
FIG. 4 is a side view illustrating the adjustability of the L-shaped link and associated legs.

With reference now to the drawings, and in particular to FIG. 1 thereof, the preferred embodiment of the new and improved golf bag with stand embodying the principles and concepts of the present invention and generally designated by the reference numeral 10 will be described.

The present invention may be construed as a system stand 10 having a plurality of components. In their broadest context such components include a bag bottom, a bag top, bag stays, a fabric enclosure, a bracket guide, a foot, an activating rod, a pair of legs, an L-shaped link and a wire link in a V-shaped configuration.

More specifically, the golf bag 12 of the present invention may be of any commercial variety. It is fabricated to include a bag bottom 14. The bag bottom is formed of a generally rigid material. It is formed to have an imperforate upper surface 16. The upper surface is for receiving thereon the upper ends of golf clubs, not shown. The golf bag bottom also has a lower surface 18. Such lower surface is positionable on a recipient surface such as the ground. The bag bottom also has a periphery 20 of a first shape.

In association with the bag bottom is a bag top 24. Such top is formed of a generally rigid material. It has at least one aperture 26 extending therethrough. The aperture is for receiving golf clubs to be carried. The bag top also has a periphery 26. Such periphery is of a shape essentially coextensive with the first shape of the bag bottom.

Next provided are a plurality of bag stays 30, 32, 34 and 36. Each of the stays is formed of a generally rigid material. The bag stays are formed with upper ends secured in apertures on the lower surface of the bag top at its periphery. The bag stays also have lower ends 38. Such ends are secured to the bag bottom in apertures in the periphery. Such stays function to maintain the bag top and bottom at a fixed distance from each other. The distance is generally less than the length of the golf clubs to be carried therein. The bag stays include front stays 30, 32 near the front of the bag. The bag stays also include rear stays 34, 36 near the rear of the bag.

Next provided is a fabric enclosure 42. The fabric enclosure surrounds the bag stays. Such enclosure has an upper end 44 coupled to the bag top near its lower surface. The fabric enclosure also has a lower end 46. The lower end is coupled to the bag bottom adjacent its upper surface.

Figure 6:
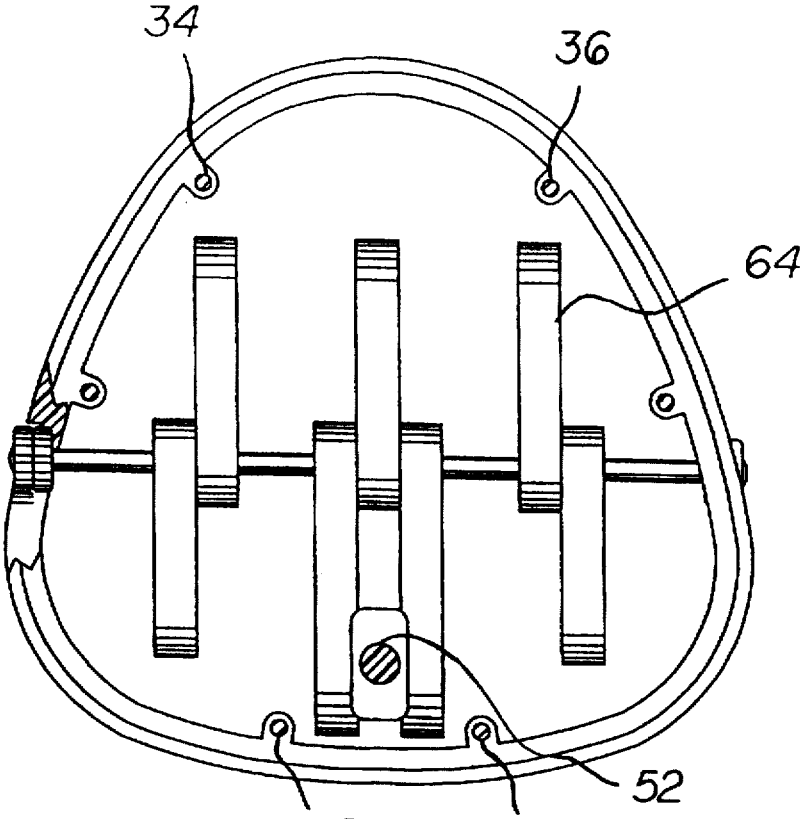
FIG. 6 is an interior view of the foot and bottom of the golf bag.
Figure 7:
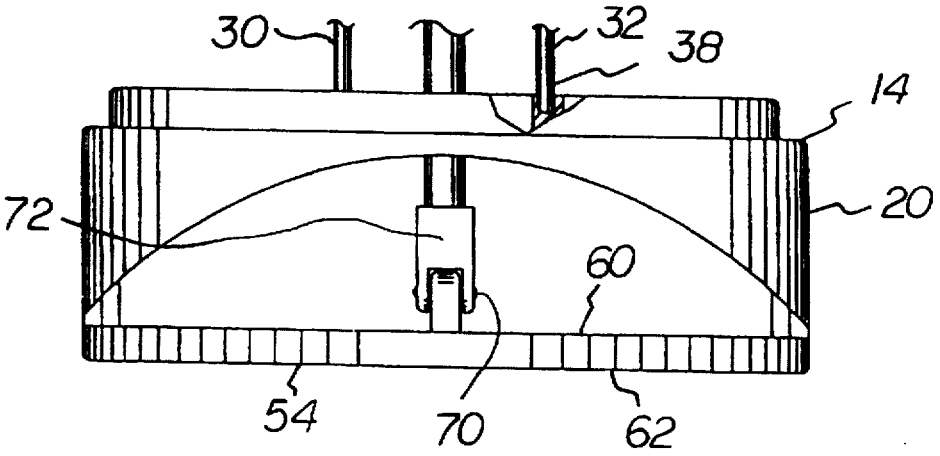
FIG. 7 is a front view of the bottom of the golf bag and associated pivoting foot.
Figure 8:
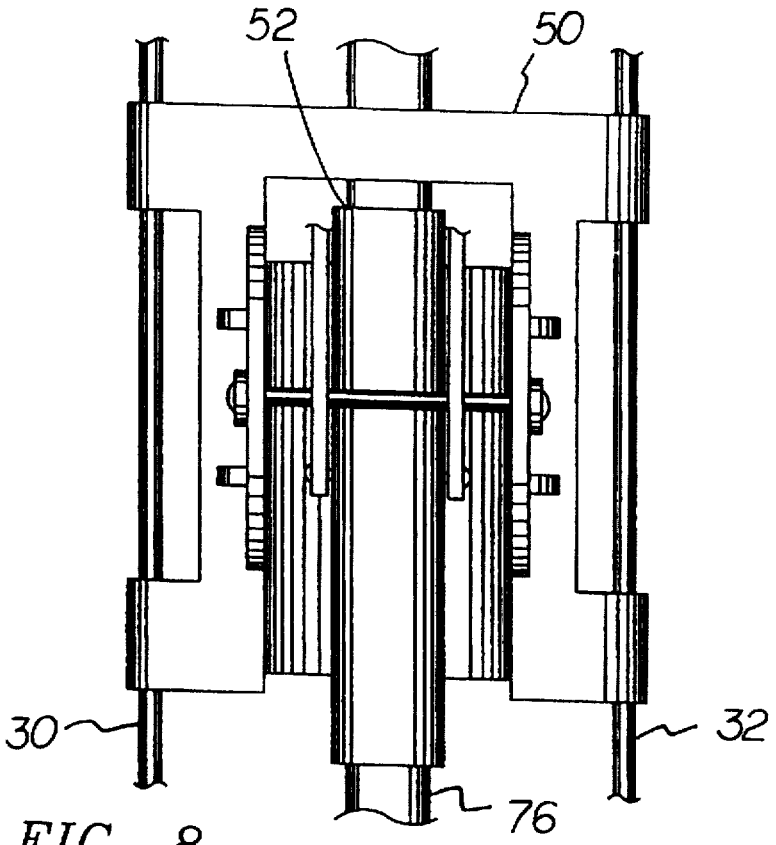
FIG. 8 is a front elevational view of the guide bracket with the L-shaped link coupled thereto.
Figure 9:
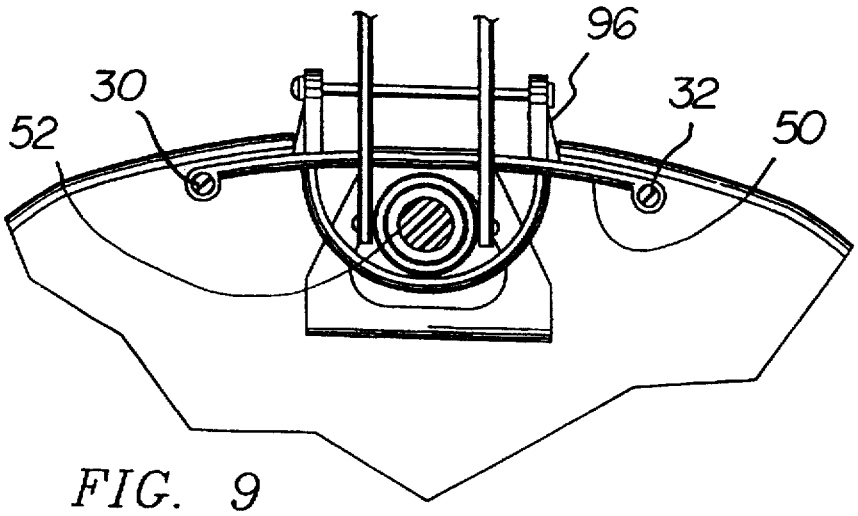
FIG. 9 is a cross-sectional view of the interconnection of the L-shaped link, guide bracket, activating rod, and stays.
Figure 10:
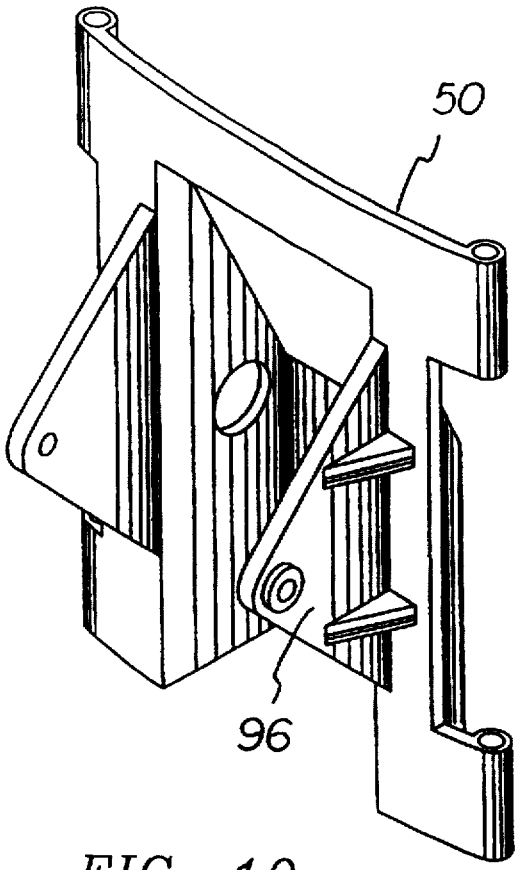
FIG. 10 is a perspective illustration of the guide bracket.
Figure 11:
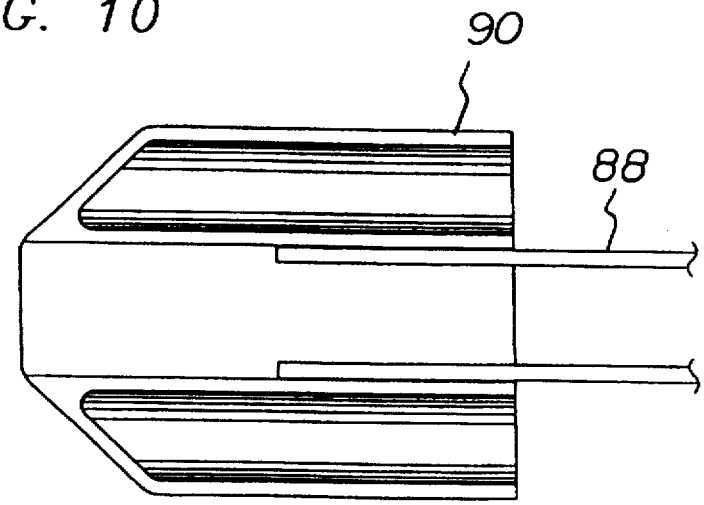
FIG. 11 is a bottom view of the exterior end of the L-shaped link.

The next major component of the system is a guide bracket 50. The guide bracket is fixedly secured to the front stays. It is formed to have a central bore 52 extending therethrough. Such bore is in a vertical orientation. The bore is essentially parallel with the bag stays. A foot 54 is next provided. The foot is pivotally secured through an axle 56 at a foot pivot point 58. This pivotal coupling is to the lower surface of the bag bottom. The foot has an upper surface 60 and a lower surface 62. The lower surface is positionable on the ground. As shown in FIG. 6, the foot and bottom of the golf bag have a plurality of support members 64 formed therein.

Figure 5:
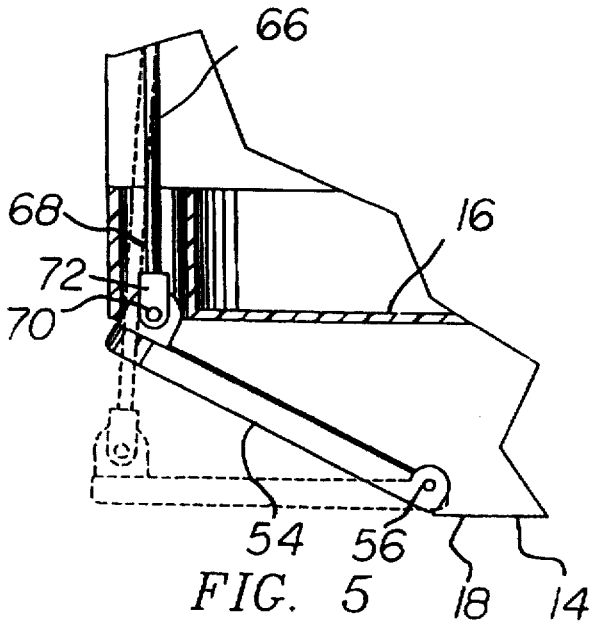
FIG. 5 is a close-up cross-sectional view of the bottom of the golf bag and associated pivoting foot.

An activating rod 66 is next provided to constitute the first component of a four bar linkage of the combination. The activating rod has a lower end 68. Such lower end is pivotally secured to the foot through an axle 70 and a clevis 72 extending upwardly from the foot. Such pivotal securement of the activating rod to the foot is at the end of the foot remote from its pivot point to the bag bottom. The activating rod also has an upper end 74. Such upper end is pivotally spaced beneath the bag top. In addition, the activating rod has an intermediate portion 76. Such intermediate portion is slidably received within the guide bracket. The entire activating rod is adapted to be raised and lowered in association with the lifting and lowering of the foot. It is imperative that the activating rod be flexible since an outboard end of the foot does not follow a vertical path when pivoting. Note FIG. 5.

A three-point connection is made through a pair of legs 80 which constitute the second bar of the linkage. Each of the legs has a lower end with a ball 82. The balls and legs are positionable adjacent to the lower end of the front stays when in a retracted orientation. When in a deployed orientation, the legs are located remote from the foot for forming with the foot a three-point contact on the ground. This is for holding the bag upon the ground in a stable orientation for the selection of clubs without holding the bag. In addition, the legs have upper ends 84 with apertures 86.

The third bar of the four bar linkage is an L-shaped link 88 which functions to couple the upper end of the legs with the actuating rod of the golf bag. The L-shaped link is located adjacent its upper end to the bag above the guide bracket. The L-shaped link has an exterior end 90 with a pin 92 pivotally attached to the upper end of the legs. The link also has an intermediate pivot point 94 fixedly secured with respect to the front bag stays through a clevis 96. Finally, an interior end 98 of the L-shaped link is pivotally coupled to the activating rod.

The last bar of the four bar linkage of the system is a wire link 100. The wire link is in a V-shaped configuration. It has a lower downwardly pointing end 102. Such end is pivotally secured with respect to the activating rod beneath the guide bracket. The wire link has upper ends 104. Such upper ends are pivotally secured to the legs adjacent to the L-shaped link.

With the arrangement as described above, when placing the bag on the ground, and pivoting it forwardly, such action will pivot the foot upwardly to raise the activating rod. This thereby raises the upper end of the wire link and the interior end of the L-shaped link. This functions to move the legs from the retracted orientation to the deployed orientation and further extend the exterior end of the L-shaped link outwardly. Upon lifting the bag from the ground, the weight of the activating rod and the legs will cause them to lower to bring the leg and activating rod and foot to the retracted orientation.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A golf bag with an associated stand comprising, in combination:

a bag bottom formed of a generally rigid material having an imperforate upper surface for receiving thereon upper ends of golf clubs, the bag bottom further having a lower surface positionable on the ground, the bag bottom also including a periphery having a first shape;

a bag top formed of a generally rigid material having apertures therethrough for receiving golf clubs to be carried, the bag top having a periphery of a shape essentially coextensive with the first shape of the periphery of the bag bottom;

a plurality of parallel bag stays of a generally rigid material having upper ends secured to the bag top periphery and having lower ends secured to the bag bottom periphery to maintain the bag top and bottom at a fixed distance from each other, the distance being less than a length of the golf clubs to be carried therein, the bag stays including front stays and rear stays;

a fabric enclosure surrounding the bag stays with an upper end coupled to the bag top and a lower end coupled to the bag bottom;

a guide bracket fixedly secured to the front stays with a circular bore extending through the guide bracket in a vertical orientation;

a foot pivotally secured through a foot pivot point to the lower surface of the bag bottom, the foot having an upper surface and a lower surface, wherein the lower surface of the foot is positionable on the ground;

an elongated activating rod having a lower end pivotally secured to the foot and having an upper end positioned beneath the bag top, the elongated activating rod further having an intermediate portion slidably received within the guide bracket;

a pair of legs having lower ends with balls positionable in a retracted orientation adjacent to the lower end of the front stays and positionable in a deployed orientation remote from the foot for forming with the foot a three-point contact on the ground for holding the bag upon the ground, the legs having upper ends with apertures;

an L-shaped link having an interior end pivotally secured to the activating rod within the guide bracket and having an exterior end with a pin pivotally attached to the upper ends of the legs and having an intermediate pivot point pivotally secured to the guide bracket; and a wire link in a V-shaped configuration with a lower end pivotally secured to the activating rod beneath the guide bracket and having upper ends pivotally secured to the legs adjacent to the L-shaped link whereby placing the bag on the ground and pivoting it forward will pivot the foot upwardly to raise the activating rod and thereby raise the lower end of the wire link and the interior end of the L-shaped link to move the legs from the retracted orientation to the deployed orientation.

2. A golf bag with an associated stand comprising:

a bag bottom, a bag top formed of a generally rigid material and an enclosure and a guide bracket fixedly secured to the bag with a circular bore extending therethrough in a vertical orientation and a foot pivotally secured through a foot pivot point to the bag bottom;

a first link formed as an elongated activating rod having a lower end secured to the foot and having an upper end with an intermediate portion slidably received within the guide bracket;

a second link formed as a pair of legs having lower ends positionable in a retracted orientation adjacent to the lower end of the bag and positionable in a deployed orientation remote from the bag, the legs having upper ends;

a third link having an interior end pivotally secured to the activating rod, an exterior end pivotally attached to the upper ends of the legs and having an intermediate pivot point pivotally secured to the guide bracket; and a fourth link formed as a wire link with a lower end pivotally secured to the activating rod and having an upper end pivotally secured to the legs.

3. The apparatus as set forth in claim 2 wherein the third link is an L-shaped member.

* * * * *